US012084796B2

(12) United States Patent
Cortinovis

(10) Patent No.: US 12,084,796 B2
(45) Date of Patent: Sep. 10, 2024

(54) CONTAINING FABRIC, GARMENTS COMPRISING SUCH FABRIC, AND RELATED PRODUCTION METHODS

(71) Applicant: Laura Cortinovis, Collebeato (IT)

(72) Inventor: Laura Cortinovis, Collebeato (IT)

(73) Assignee: Laura Cortinovis, Collebeato (IT)

( * ) Notice: Subject to any disclaimer, the term of this patent is extended or adjusted under 35 U.S.C. 154(b) by 0 days.

(21) Appl. No.: 18/131,122

(22) Filed: Apr. 5, 2023

(65) Prior Publication Data

US 2023/0235492 A1 Jul. 27, 2023

Related U.S. Application Data

(62) Division of application No. 17/058,226, filed as application No. PCT/IT2018/000077 on May 25, 2018.

(51) Int. Cl.

| | |
|---|---|
| ***D04B 1/26*** | (2006.01) |
| ***D04B 1/12*** | (2006.01) |
| ***D04B 1/18*** | (2006.01) |

(52) U.S. Cl.

CPC ..... *D04B 1/26* (2013.01); *D04B 1/126* (2013.01); *D04B 1/18* (2013.01); *D10B 2509/028* (2013.01)

(58) Field of Classification Search

None

See application file for complete search history.

(56) References Cited

U.S. PATENT DOCUMENTS

| | | | |
|---|---|---|---|
| 951,003 | A | 3/1910 | Steber |
| 2,014,026 | A | 9/1935 | Nebel |
| 2,347,005 | A | 4/1944 | Smith, Jr. |
| 2,714,813 | A | 8/1955 | Hill |
| 2,946,211 | A | 7/1960 | Morancy |
| 2,979,927 | A | 4/1961 | Wakefield |
| 3,181,313 | A | 5/1965 | Crawford |
| 3,212,299 | A | 10/1965 | Frederick |
| 3,319,440 | A | 5/1967 | Max |
| 4,028,910 | A | 6/1977 | Wignall |
| 4,034,581 | A | 7/1977 | Swafford |
| 5,445,598 | A | 8/1995 | Nguyen-Senderowicz |
| 5,898,948 | A | 5/1999 | Kelly |

(Continued)

FOREIGN PATENT DOCUMENTS

| | | | |
|---|---|---|---|
| GB | 634830 | A | 3/1950 |
| JP | 2009155763 | A | 7/2009 |

(Continued)

*Primary Examiner* — Grace Huang

(74) *Attorney, Agent, or Firm* — Volpe Koenig

(57) ABSTRACT

A method for manufacturing a knit garment comprising at least one portion of a restraining fabric including at least one stretch portion having a plurality of stitches of at least one ground yarn and at least one elastic yarn. In which, next to at least part of the stretch portion, a restraining portion extends in which first groups of one or more first stitches including the at least one main yarn alternate with second groups of one or more second stitches having a restraining yarn, such that at each of the first stitches a floating length of the restraining yarn extends and at each of the second stitches a floating length of the main yarn extends. The restraining garments containing the fabric and the method of manufacturing the fabric and garments are also provided for.

5 Claims, 10 Drawing Sheets

(56) References Cited

U.S. PATENT DOCUMENTS

| | | | |
|---|---|---|---|
| 6,805,681 | B2 | 10/2004 | Yokoyama |
| 7,677,061 | B2 | 3/2010 | Mori |
| 7,827,829 | B2 | 11/2010 | Fujikawa |
| 8,156,768 | B2 | 4/2012 | Green |
| 8,973,411 | B2 | 3/2015 | Gaither |
| 9,689,092 | B2 | 6/2017 | Liao |
| 10,206,439 | B2 | 2/2019 | Matsuo |
| 10,398,584 | B2 | 9/2019 | Iida |
| 10,876,232 | B2 | 12/2020 | Nishigaki |
| 11,311,055 | B2 | 4/2022 | De Freitas Silva |
| 11,542,641 | B2 | 1/2023 | Atmanspacher |
| 2009/0013450 | A1 | 1/2009 | Lambertz |
| 2021/0148018 | A1 | 5/2021 | Colosio |
| 2022/0322756 | A1 | 10/2022 | Stull |

FOREIGN PATENT DOCUMENTS

| | | | |
|---|---|---|---|
| KR | 20060083028 | A | 7/2006 |
| KR | 101465104 | B1 | 11/2014 |
| WO | 2012067645 | A1 | 5/2012 |
| WO | 2016157227 | A1 | 10/2016 |

12
R1
R2
Ri
20
18
21
7
6
17
8
4
1
19
Rf
Rn
22
23
G1
G2
P2
P1

7
10'
10

CONTAINING FABRIC, GARMENTS COMPRISING SUCH FABRIC, AND RELATED PRODUCTION METHODS

CROSS REFERENCE TO RELATED APPLICATIONS

This application is a divisional of U.S. patent application Ser. No. 17/058,226, filed Nov. 24, 2020, which is a 371 National Stage Entry of PCT/IT2018/000077, filed May 25, 2018, the entire contents of all of which are incorporated by reference herein as if fully set forth.

FIELD OF THE INVENTION

The present invention generally relates to the field of knitwear and specifically concerns a knit fabric, as well as knit garments. The invention further relates to a method for manufacturing such a fabric and garments, by circular machines for knitwear and hosiery.

BACKGROUND

Restraining type fabrics are known, suitable for exerting a function of restraining a user's body part, on which they are worn.

In particular also garments to be worn at the user's joints or other body parts are known, having orthopedic or restraining functions, such as elastic ankle braces, elastic knee braces and the like. Such garments have elastic portions shaped and designed such as to keep the joint, or however the body part they are associated with, in correct positions, thus preventing wrong movements which could cause traumas, and can be worn for both preventive action and upon traumas that impaired the joint, mostly lateral, stamina.

These garments usually comprise elastic crossed strips, which let an intermediate portion uncovered, or anyway comprise a more extensible intermediate portion, in order to allow the joint movements.

As until now implemented, such garments feature seams to bond the several portions to one another and, in particular, to bond the elastic strips to one another; such seams are, however, particularly uncomfortable once the garment has been worn since they are pressed on the skin.

In addition, for example in the case of the ankle braces, they are usually worn under a sock and thus they constitute a double encumbrance that can become very uncomfortable in case footwear has to be worn.

On the other hand, graded compression socks are also known, serving for applying a different compression at a users' foot, in order to help in case of swelling, weakness or inflammation of the plantar arch, or heel pain.

Such garments comprise circumferential elastic strips to brace the foot portion to be treated. However, such a garment does not provide any support to the joint it is associated with, and specifically the ankle. In fact, such garments simply have portions in which an elastic yarn is knitted, in order to provide the fabric with elasticity, together with or alternatively to the yarn making the remaining of the garment. The elastic yarn is extensible and deformable by nature; therefore, such portions compress the body part they are associated with, but have not any restraining and movement restricting functions.

Also, the restraining fabrics are usually made by simply adding elastic yarns knitted in combination with other yarns.

Knit garments exist as well, such as socks and the like, comprising reinforcing portions usually arranged in the parts to be worn on the front parts of a user's leg and foot. Such reinforcements are usually knitted with terry stitches obtained by knitting one or more yarns and having the only function of making a layer thicker than the remaining part of the sock, in order to protect the limb against possible impacts, or when worn in stiff footwear such as a boot or an bootee.

In WO 2012/067645A is described a knit sock which includes a foot portion having an inner arch region incorporating a targeted compression zone adapted to reside generally adjacent an inner arch of a wearer's foot. The compression zone includes axially extending compression ridges of variable length spaced apart from a top of the compression zone to a bottom of the compression zone. When the sock is worn, a compression force applied by the foot portion within the targeted compression zone is greater than the compression force in directly adjacent areas of said foot portion.

U.S. Pat. No. 4,034,581 A concerns a sock, wherein the major portion of the leg of the sock is knit with first and second yarns of different colors in plated relationship with the first yarn being positioned on the outside and the second yarn being positioned on the inside so that the color of the first yarn predominates in the major portion of the leg of the sock. Spaced apart pattern areas are formed in the leg and are knit of the second yarn only with the first yarn being floated inside so that the spaced apart pattern areas are of a different color than the major portion of the leg.

Document WO 2016/157227 A1 relates to a garment with elastic inserts produced on circular machines of the type comprising elasticized sectors (3) and elasticized zones obtained by working in a further elastomeric yarn—in addition to the ground yarn and the reinforcing yarn normally used—and actually knitting the yarns so as to create machined portions, both horizontally and obliquely, which result in well-defined and demarcated zones which provide greater compression than the knitted stitches on the same row, thereby providing—within the elasticized sectors—a greater compression value than outside the sector on the same row of knitted stitches. The elasticized sectors are designed portions which create ornamental figures or banding with specific compression which can provide support, contribute to the stimulation of blood circulation, reduce fatigue, and render movement safer and more supported, when properly positioned and sized.

SUMMARY

The present invention has been designed with the aim of compensating for the drawbacks of the known art by providing a texture of knit fabric which is elastic but also has a restraining effect, thus suitable to provide support when worn.

A further object is to provide a tubular knit garment substantially seamless for the assembly thereof, adapted to be worn at a joint, such as a user's ankle, knee, elbow, wrist, in order to restrain and restrict his movements, by keeping the joint itself in the correct position.

A further object is to provide a stocking- or sock-like garment, embedding an elastic ankle brace, which is particularly comfortable, being seamless, possibly except for the one for closing the toe.

Such objects are accomplished by a knit fabric having at least one stretch portion, comprising elastic stitches obtained by knitting at least one ground yarn and one elastic yarn.

According to the invention the stretch portion has at least one restraining portion comprising stitches obtained by knitting also a restraining yarn alternately with at least one main yarn, such that at the stitches comprising the restraining yarn, floating lengths of the main yarn are formed, and vice versa.

Preferably, the main yarn knitted in the restraining portion is also knitted in the remaining part of the stretch portion and even more preferably in the whole knit fabric.

Advantageously, also there may be at least one second main yarn to be knitted in the restraining portion and/or the remaining part of the knit fabric, alternatively or in addition to the first main yarn.

In a preferred solution, said stretched portion comprises stitches in which the elastic yarn is knitted, which alternate with stitches in which the elastic yarn can float, i.e., it is not knitted and therefore forms lengths of elastic yarn which are visible and freely extend from a so-called reverse side of the tubular fabric, thus forming a so-called "mocked rib" knit visible on the opposite side of the fabric, named face. For example, at least one elastic stitch, i.e. a stitch comprising the elastic yarn, alternates with at least one non-elastic yarn, wherein the elastic yarn remains floating. This way the floating elastic yarn aims at moving two consecutive groups of elastic stitches closer, thus providing the stocking with a rib knit effect. By the terms "rib knit" a knit usually obtained by alternating plain stitches with purl stitches is meant.

Advantageously, at part of the stretch portion stitches also the main yarn and the restraining yarn are alternatively knitted with one another, such as to make lengths of floating yarn on the reverse side of the fabric. The floating yarn lengths, being linear lengths, are less extensible by nature than the knitted threat lengths forming curves, or loops, constituting the stitches themselves; therefore, a knit comprising floating yarn lengths is little extensible, with a resulting restraining effect. Therefore, the elastic portion, comprising mock ribs of elastic yarn, provides the knit fabric with elasticity, while the combination with the alternating knitting of the main yarn with the restraining yarn, by forming float stitches, reduces such elasticity while providing the joint with the desired support.

Said main and restraining yarns can be equal, in terms of typology and/or size, but preferably have different size; advantageously the restraining yarn can have higher linear density, preferably equal to twice the linear density of the restraining yarn. By the term "linear density" a quantity related to the yarn diameter is meant. In other words, the restraining yarn diameter is about twice the main yarn diameter, or vice versa.

In a preferred solution, in at least one portion of the knit fabric the restraining portion comprises at least two stitches of the main yarn, which alternate with at least two stitches of the restraining yarn, in order to form lengths of floating yarn, which extend next to at least two stitches. Such an arrangement is defined as selection 2:2. However, other selections such as 1:1, 2:1, 2:3, 3:2, 4:2, etc., allowing to still have a fabric holding its support and elastic compression characteristics, are possible.

In particular, the fabric can comprise restraining portions having different selections, in order to afford a different restraining degree to the different areas of the fabric itself.

Advantageously, said main yarn and restraining yarn work alternatively with one another and are not cut within each fabric restraining portion, in order to make floating yarn lengths on the fabric reverse side in order to reduce the extensibility of the fabric itself. At least the restraining yarn can instead be cut at the edges of each restraining portion.

Preferably, such a knit fabric has tubular shape, consists of a plurality of courses and can be made in different diameters and/or sizes. With the term "course" the row of stitches composing each one of the lines of stitches extending in transverse direction of the knit fabric is meant.

Advantageously said knit fabric can be part of a garment to be worn on a joint such as an ankle, a knee, an elbow, etc.

Therefore, the invention also relates to a knit garment, according to claim 6, for restraining a joint, which comprises a stretched portion obtained by knitting an elastic yarn, and a restraining portion extending next to at least part of the stretched portion and comprising stitches of a main yarn which alternate with stitches of a restraining yarn. This way, lengths of restraining yarn extend behind the main yarn stitches, while lengths of main yarn extend behind the restraining yarn stitches.

Specifically, such a garment has a tubular shape and comprises at least one upper part, one first intermediate semi-portion, one second intermediate semi-portion and one lower portion.

Advantageously the restraining portion extends next to part of said upper and lower portions and next to at least part of said first intermediate semi-portion.

Preferably the restraining portion, in order to follow the shape of the limb it is associated with and to allow the usual joint movements, comprises upper and lower strips extending sloped and joining to one another at the first intermediate semi-portion of the garment.

Advantageously the second intermediate semi-portion is shaped as a bag to accommodate a user's heel, knee or elbow. Still more advantageously, the restraining portion and possibly also the stretch portion do not extend at the second intermediate semi-portion in order not to restrict the movements thereof, compress and bother the body parts it is associated with.

The garment can be an elastic ankle brace, a sock with ankle brace, an elastic knee brace and the like.

In such garments the main yarn, which is knitted at least at the restraining portion, can be also used in the remaining part of the garment, or alternatively or in addition at least one second main yarn can be provided for the remaining part of the garment.

Advantageously, the sock with ankle brace is highly comfortable since the elastic ankle brace is part of the garment itself. Therefore, such a garment has the double function of sock and elastic ankle brace in a single fabric layer, thus avoiding cumbersome garment overlaps usually unavoidable when both an ankle brace and a sock must be worn.

Advantageously, also the elastic knee brace could be part of a larger extent garment, such as tights or leggings; in the same way the elbow brace could be part of a sleeve and the like.

The invention also relates to a method for implementing a knit fabric provided with a stretch and restraining portion, as well as to a method for manufacturing stretch garments having restraining effect.

Specifically, the method comprises the steps required for making the portions constituting the fabric or garment and the additional steps for making a stretch portion by knitting an elastic yarn and at least one restraining portion extending next to at least part of the stretch portion, which is obtained by alternately knitting also a main yarn and a restraining yarn with one another such that stitches comprising the main yarn are formed, which alternate with stitches comprising the restraining yarn and such that, at the stitches containing the main yarn, floating lengths of the restraining yarn extend, and, vice versa, at the stitches containing the restraining yarn, floating lengths of the main yarn extend.

BRIEF DESCRIPTION OF THE DRAWINGS

However, the invention will be further depicted in the following in the description made in reference to the accompanying indicative and not limitative drawings, in which.

DETAILED DESCRIPTION OF THE PREFERRED EMBODIMENTS

Figure 1:
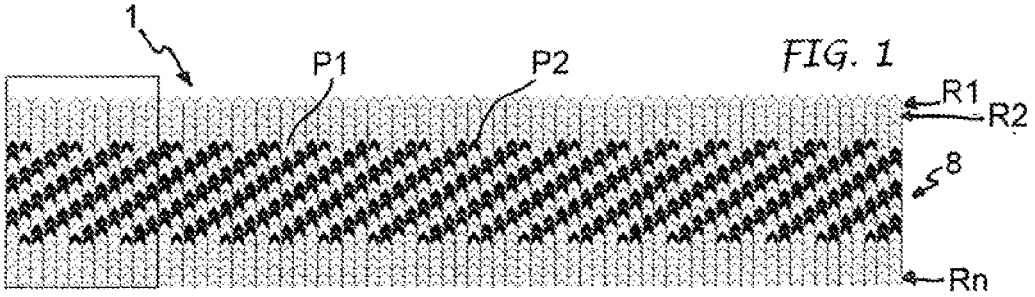
FIGS. 1 and 2 schematically show a knit fabric according to the present invention, seen from opposite sides.
Figure 2:
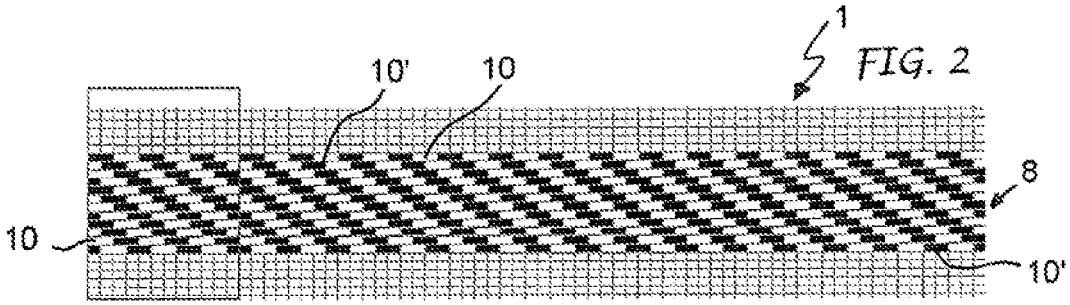

In FIGS. 1 and 2, a knit fabric according to the present invention is denoted on the whole by the numeral 1.

The knit fabric comprises a plurality of courses R1, R2, . . . , Rn obtained by knitting at least one ground yarn 2 and at least one main yarn 3 and comprises at least one stretch portion 4 obtained by knitting at least the ground yarn 2 and at least one elastic yarn 5 together, or by knitting the elastic yarn such that in some stitches, termed as elastic stitches 6, it becomes knitted at least with the ground yarn, while in other stitches, termed as float stitches 7, it is not knitted, thus forming lengths of elastic yarn that remain floating.

Preferably, at each subsequent course R1, R2, . . . , Rn the same sequence of stitches is repeated such that the elastic stitches and the float stitches of a course are aligned to those of the previous and subsequent course, such as to form columns.

In a preferred solution shown in the figures, in each course of the knit fabric 1 an elastic stitch alternates with a float stitch, with a so-called selection 1:1.

According to the invention, in at least one part of the stretch portion also a restraining portion 8 is obtained, by also knitting the main yarn 3 and at least one restraining yarn 9.

In the restraining portion the main yarn 3 and the restraining yarn 9 are knitted alternatively with one another, such that at first groups G1 of one or more first stitches P1 of the main yarn 3, there is a floating length of the restraining yarn 9, and vice versa at second groups G2 of one or more second stitches P2 of the restraining yarn 9, there is a floating length of the main yarn 3.

The main yarn and the restraining yarn each form a respective sequence of stitches, which comprises at least one plain-knitted stitch followed by at least one float stitch. By the terms "plain-knitted stitch" a stitch is meant wherein the yarn is knitted with the corresponding stitch of the previous course, whereas by "float stitch" a stitch is meant wherein the yarn is not knitted with the corresponding stitch of the previous course, thus originating a length of floating yarn 10, 10' extending between two subsequent stitches of the same yarn and being visible from a so-called reverse side of the knit fabric.

Preferably, at least part of the restraining portion is obtained by knitting the main yarn and the restraining yarn such that two stitches P1 of the main yarn are followed by two stitches P2 of the restraining yarn and so on, and that at two stitches P1 of the main yarn, a length of floating restraining yarn 10' is formed, whereas at two stitches P2 of the restraining yarn a length of floating main yarn 10 is formed. In other words, for each main and restraining yarns, the stitches and the float stitches alternate according to a selection 2:2.

The float stitches of the main yarn and the restraining yarn are less extensible than the plain-knitted stitches and thus decrease the extensibility of the stretch portion in order to provide the desired restraining effect. By differently alternating stitches and float stitches according to other selections, for example 1:1, 1:3, 2:2, 2:1, 2:4, etc., fabrics having different restraining ability and strength can be obtained. The kind of selection can vary among different courses, or also within the same course.

As shown in FIGS. 4 to 8, the knit fabric 1 can be part of a garment, such as to provide the garment itself with a restraining effect. Specifically, the garment is an orthopedic type garment having joint bearing and supporting purposes. More in detail, the garment can have the shape of an elastic ankle brace 11, the shape of a stocking or sock with ankle brace 12, i.e. including a portion acting as an elastic ankle brace, or the shape of an elastic knee brace 13, or else the shape of an elastic wrist brace, elastic elbow brace and the like—not shown.

In other words, the knit fabric can be embedded in a substantially tubular garment and formed in a single piece, i.e. seamless, except from possible finish seams, which has different diameter and/or shape such as to be worn at a user's ankle, knee, wrist, elbow or other joint, thus effecting a restraint of the joint itself such as to allow its usual movements but to prevent wrong twists that could cause traumas, or those the joint can undergo just as a result of a trauma.

Figure 4:
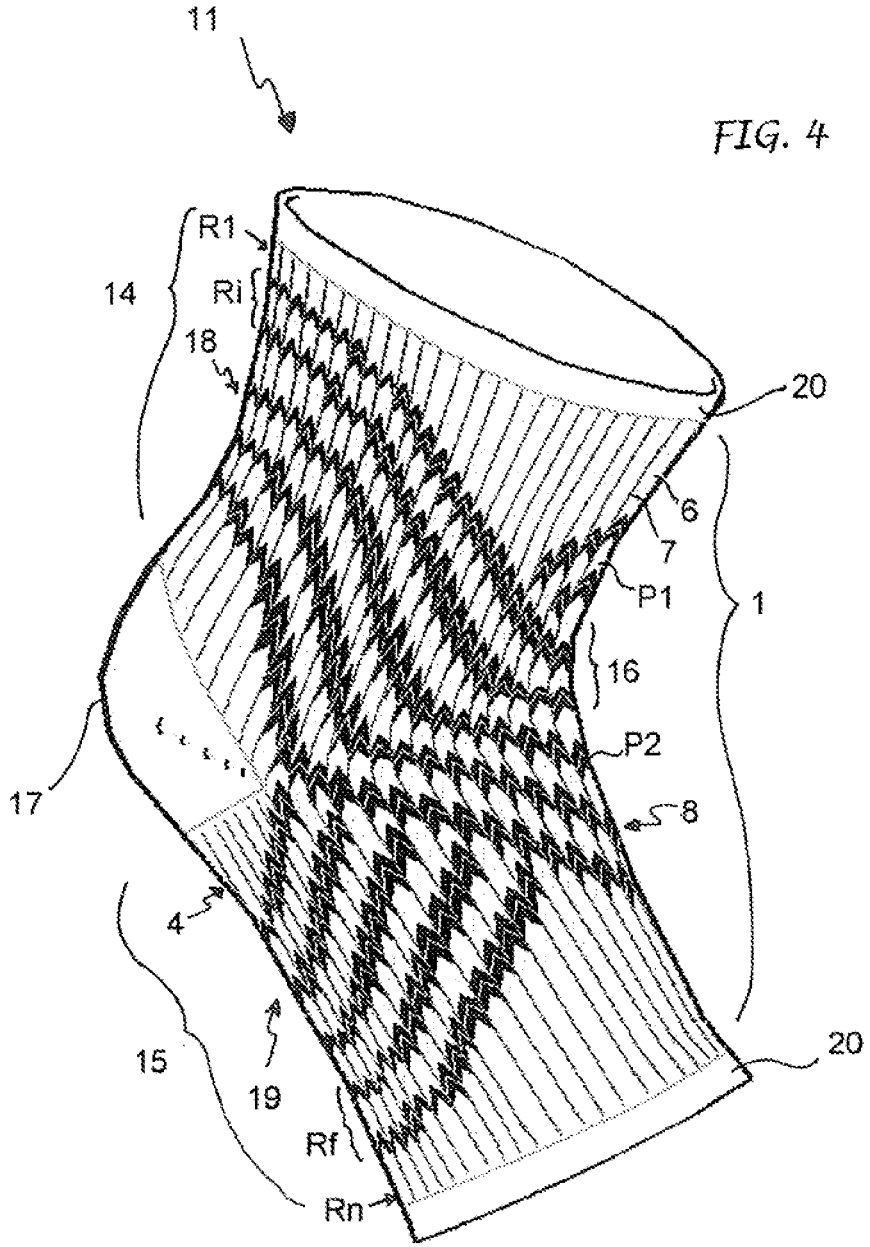
FIG. 4 shows a perspective view of a garment having the shape of an elastic ankle brace.
Figures 7, 7A, 7B:
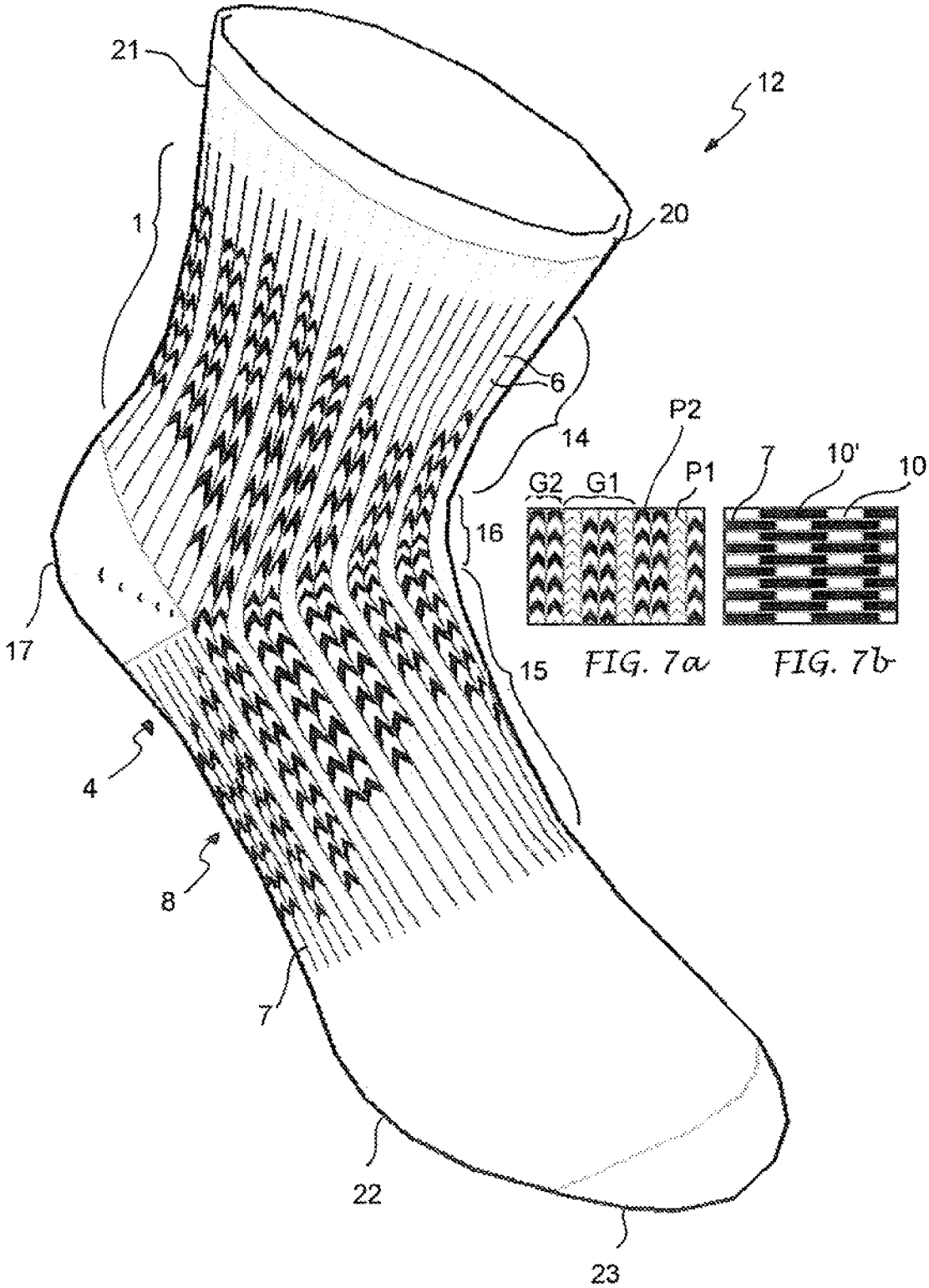
FIGS. 7 and 8 show a view from the outside and a view from the inside of another embodiment of a garment having the shape of a sock comprising a portion of elastic ankle brace.
Figures 8, 8A, 8B:
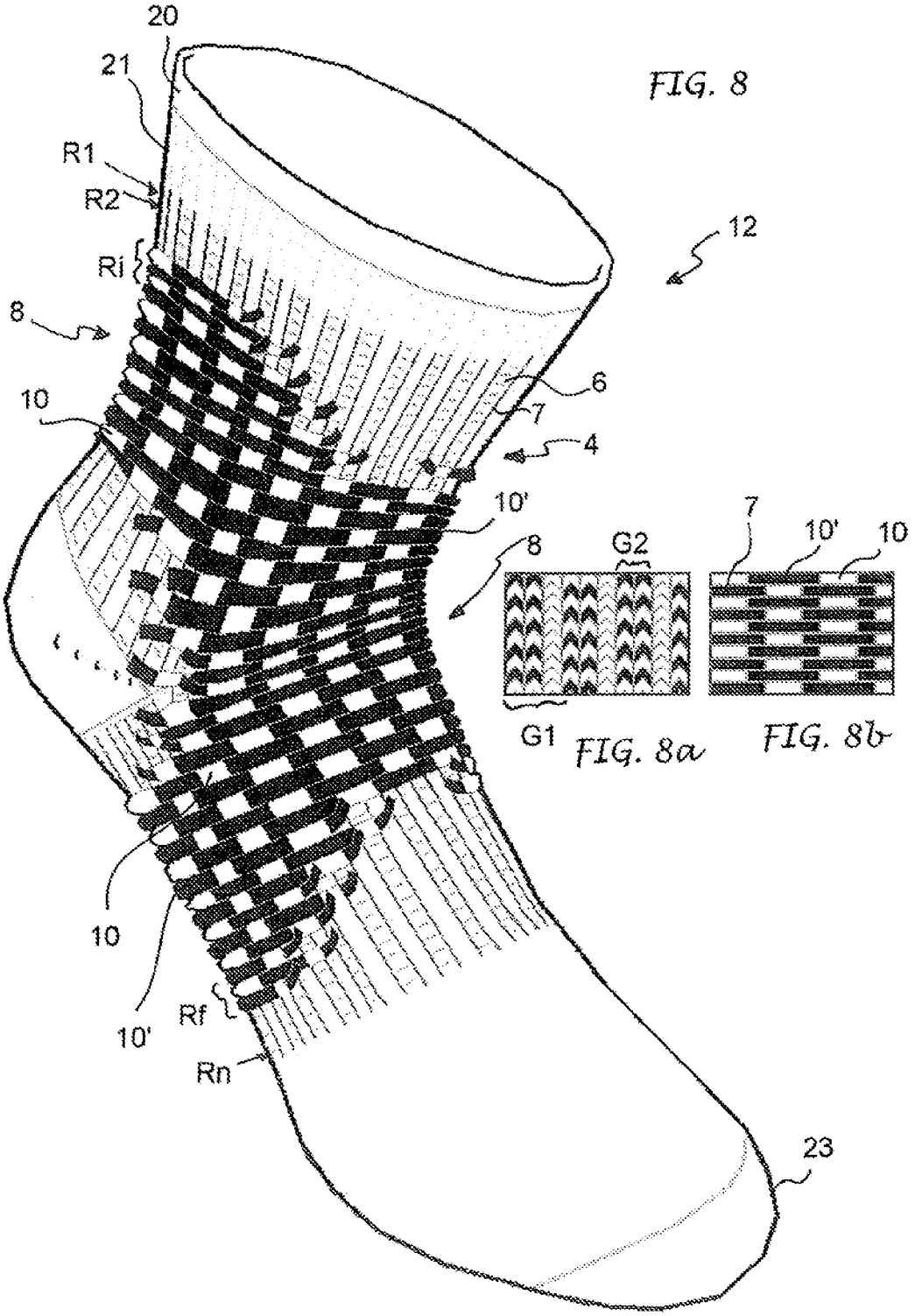
Figure 9:
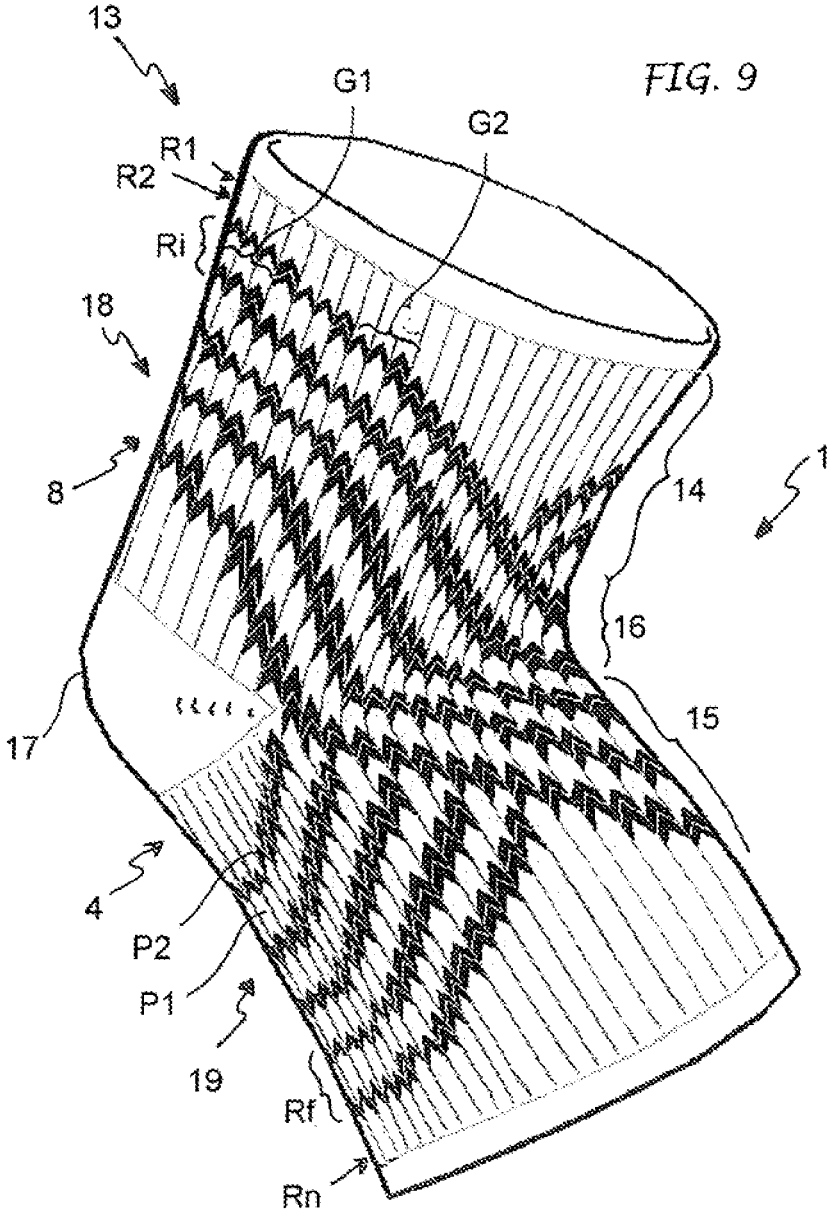
FIG. 9 shows a perspective view of a garment having the shape of an elastic knee brace.
Figure 10:
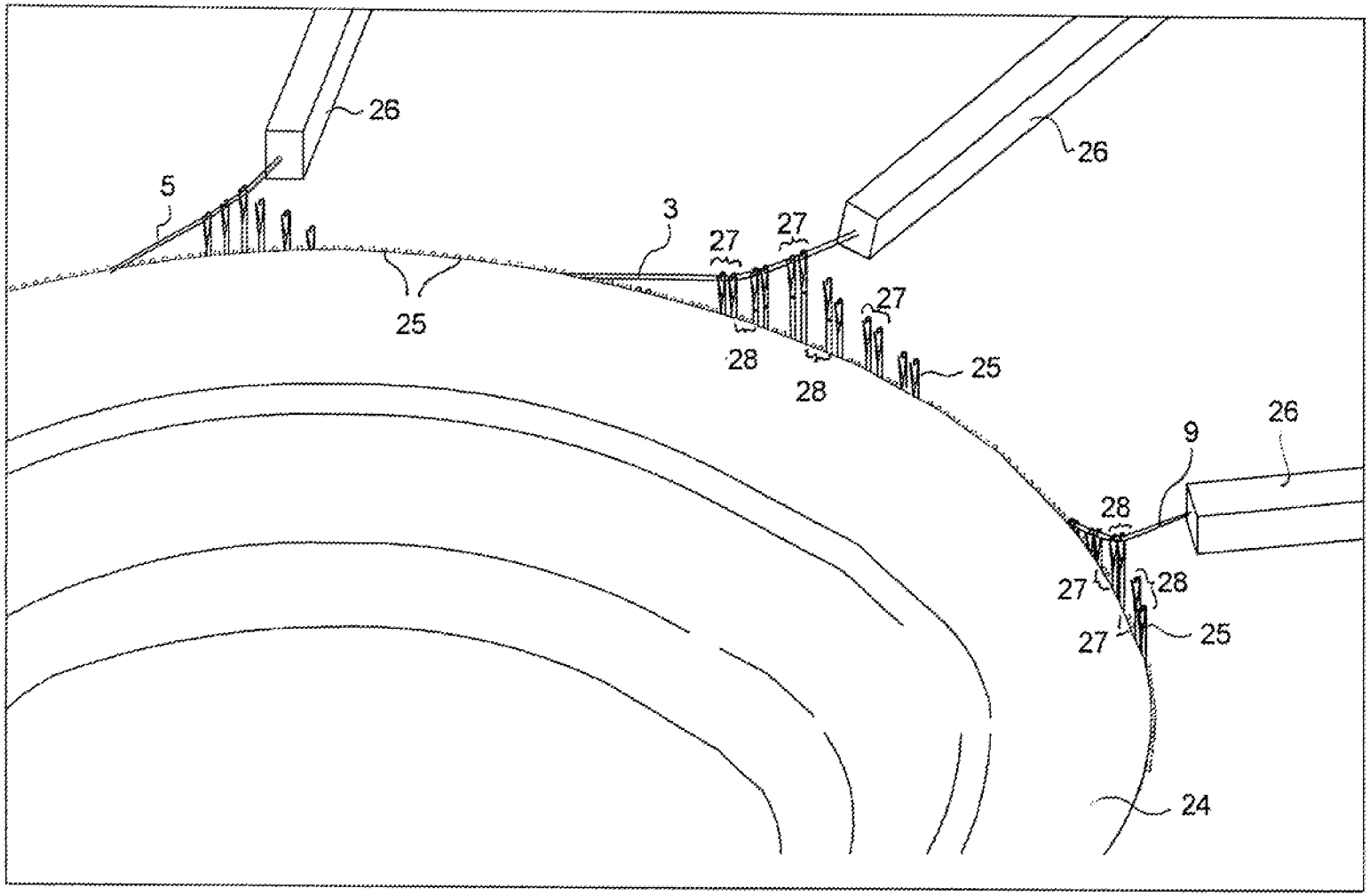
FIG. 10 shows a part of a circular machine for knitwear and hosiery for making the knit fabric and the garments according to the present invention.

In detail, the elastic ankle brace 11 shown in FIG. 4, the sock with ankle brace 12 of FIGS. 5, 6, 7 and 8 and the elastic knee brace 13 of FIG. 9, comprise an upper part 14 and a lower part 15, joined to one another by a first intermediate semi-portion 16 and a second intermediate semi-portion 17. The second intermediate semi-portion 17 is shaped like a bag to be able to accommodate respectively the user's heel or patella depending on the type of garment.

At least one portion of the upper part, lower part and first intermediate semi-portion of each garment comprises a portion of knit fabric similar to the afore described one and specifically a stretch portion 4 provided with a restraining portion 8.

In detail, the restraining portion is shaped such as to follow the conformation of the joint on which it has to be worn, in order to allow the usual movements thereof. Specifically, the restraining portion comprises an upper strip 18 and a lower strip 19 joining to one another at the first intermediate semi-portion. Preferably, such upper and lower strips are shaped such as to extend at least partially sloped with respect to the transverse direction of the upper and lower parts such that when the garment is seen laterally, a sort of V shape is formed inside which there is the second intermediate semi-portion; in other words, the two arms of the V shape surround the second semi-portion. Preferably said two arms are curved inwardly at their free end portions.

The restraining portion, seen on the whole, forms therefore a sort of coil winding around the limb portion and the joint it is associated with, letting the heel or the patella free, respectively, depending on the type of garment.

Preferably, thus in the initial courses Ri, the restraining portion only extends along a limited amount of stitches, at one part of the garment itself that can be called rear part in case of elastic ankle brace and sock with ankle brace, since to be worn on a rear portion of the user's leg and on part of the user's foot planum, or front part in case of elastic knee brace, since to be worn on front parts of the leg; in each subsequent course the amount of stitches constituting the restraining portion increases, preferably until having a restraining portion extending at all the stitches of at least one course; in the courses at the first and second semi-portions, the restraining portion only extends at the first semi-portion, such as not to extend at the heel or the patella; and eventually at the lower part, the restraining portion gets gradually narrower, meaning that it comprises a decreasing number of stitches, until comprising an extremely small number, in its final courses Rf.

Preferably, in order to better follow the shape of the anatomical part on which it has to be worn and to better exert its restraining action, the restraining portion has float stitches and stitches of the main yarn and of the restraining yarn which alternate with one another according to a variable selection, thus it does not stay constant for the whole restraining portion and/or within each course.

In a preferred solution shown in FIG. 4, at the parts to be worn on the limb portions close to the heel, there could be a sequence of higher number of stitches of each yarn, followed by float stitches of the same yarn, which decrease at the remaining part of the garment, wherein only a small number of stitches alternate with the float stitches.

Figures 5, 5A, 5B:
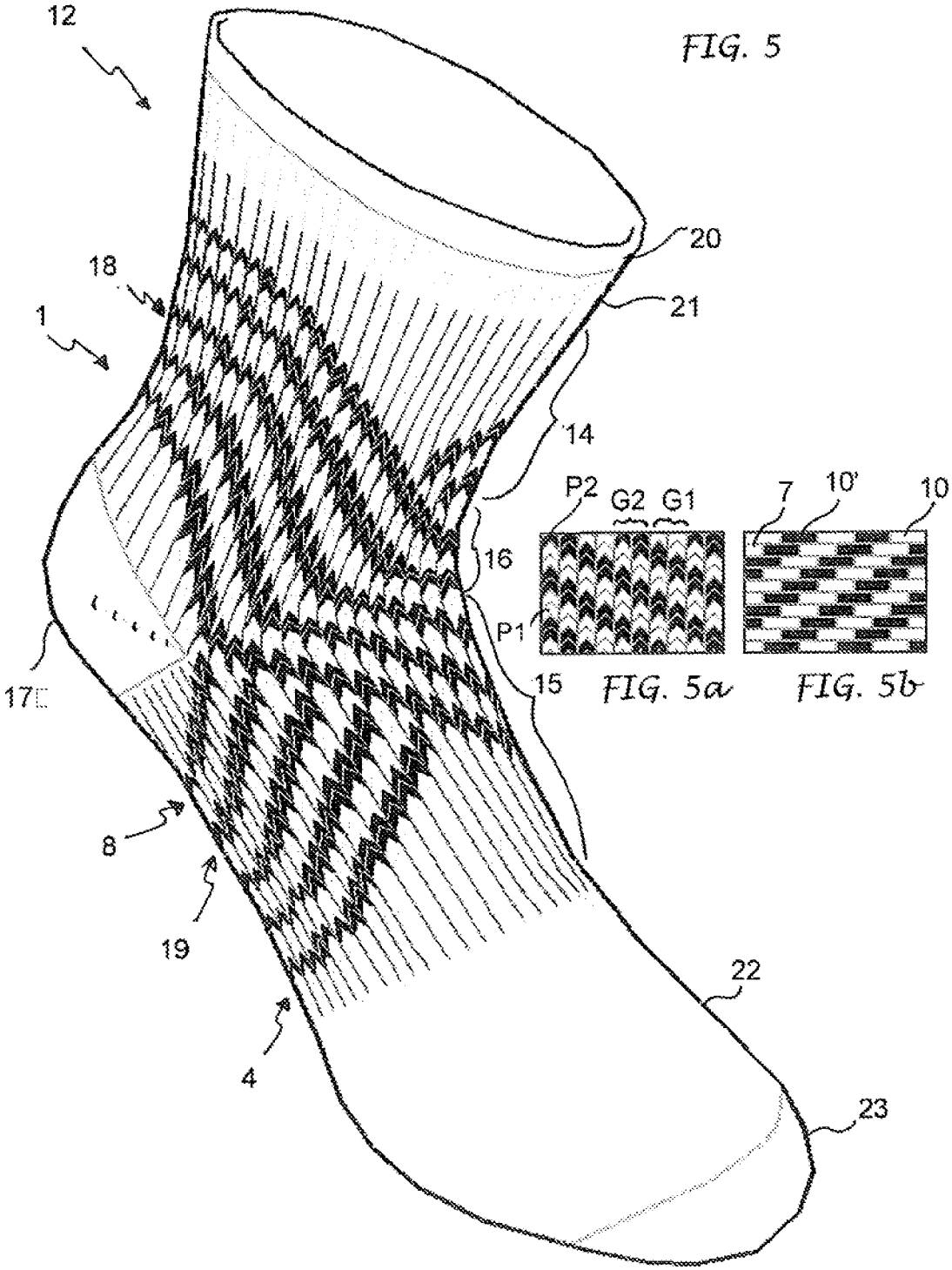
FIGS. 5 and 6 show two different embodiments of a garment having the shape of a sock comprising a portion of elastic ankle brace.
FIGS. 5*a* and 5*b*, 6*a* and 6*b*, 7*a* and 7*b*, 8*a* and 8*b* respectively show a view from the front side and a view from the reverse side of part of the garments of FIGS. 5, 6, 7 e 8.
Figures 6, 6A, 6B:
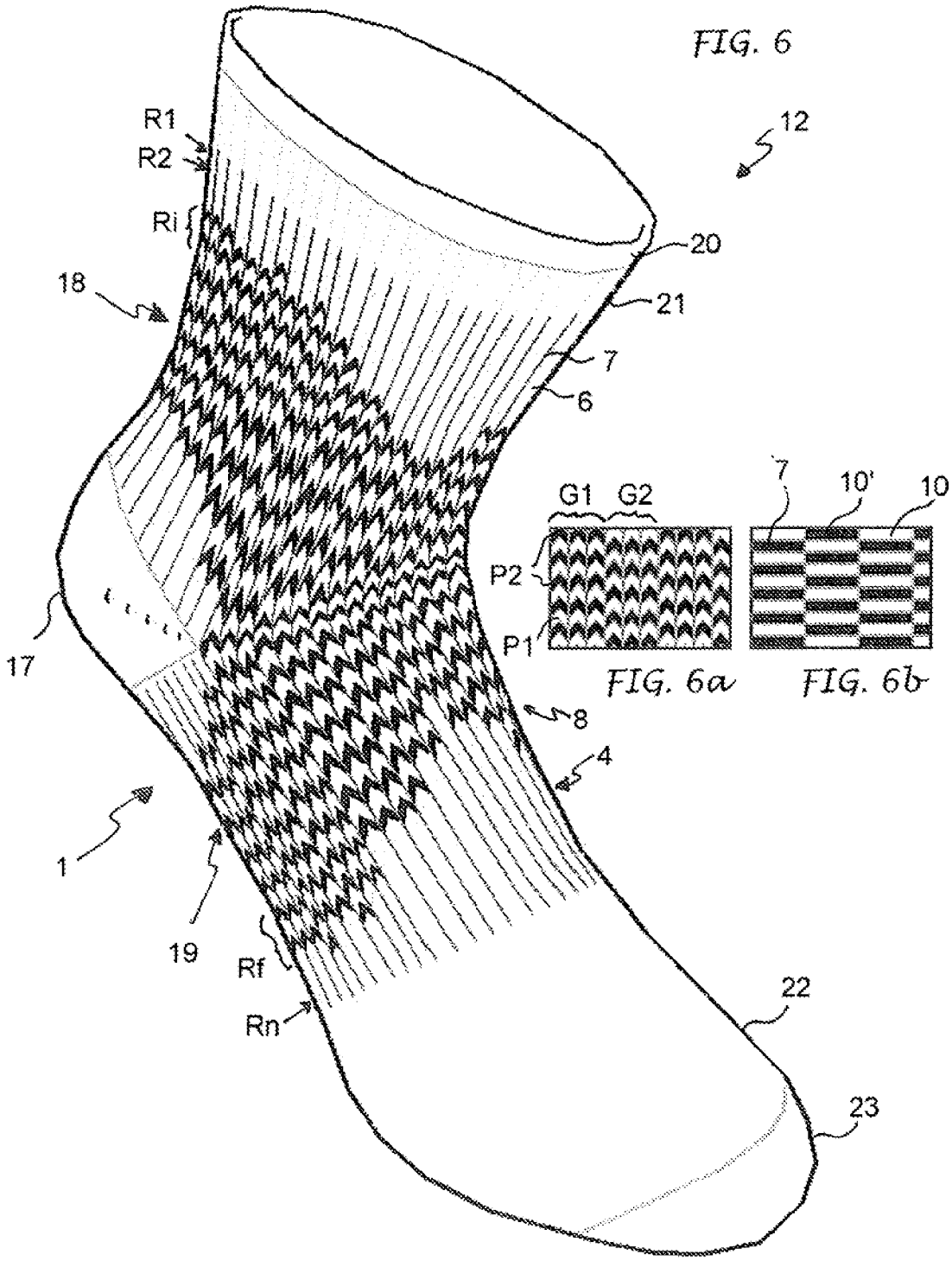

FIGS. 5, 6, 7 show three examples of possible embodiments of the sock with ankle brace wherein restraining portions are shown, in which the stitches of the main yarns alternate with the stitches of the restraining yarn according to different selections, better depicted in FIGS. 5*a*, 6*a*, and 7*a*, in order to have different restraining and/or aesthetic effects.

The main yarn and the restraining yarn can have the same linear density, or different linear densities, preferably the restraining yarn has a larger diameter, even twice the diameter of the main yarn. In fact, this way a strong restraining effect localized in the restraining portion is obtained, whereas the remaining part is lighter, thinner and particularly elastic in order to increase the garment comfort and allow it to be more easily worn.

The main yarn and the restraining yarn can have different colors so as to highlight the restraining portion with respect to the remaining part of the garment.

The stretch portion can only extend at the courses in which there is the restraining portion also, or for a larger number of courses, or else still along the whole garment.

In addition, the garment can have an elastic edge 20 at one or both the ends thereof, just one in case of sock, in order to hold the garment correctly worn.

Specifically, in reference to the elastic ankle brace of FIG. 4, the upper part is designed to be worn on an ending part of the user's leg, the lower part to be worn on a first part of the user's foot, the first intermediate semi-portion to be worn on the instep and the second intermediate semi-portion is designed like a bag to accommodate the user's heel itself.

In FIGS. 5, 6 and 7 examples of socks with ankle braces 12 are shown, each one including a portion having a function of ankle brace as the afore described one.

With respect to the afore described garment, the sock also comprises a possible leg portion 21, a forefoot portion 22 and a toe portion 23 to enclose the toes.

In this case, the finish elastic edge 20 is combined with the end of the leg portion. The leg, forefoot and toe portions can have any knitting usually present in a sock.

The elastic knee brace 13, shown in FIG. 8, has a texture similar to that of the elastic ankle brace 11, but has a larger diameter and a shape suitable to be worn on the user's knee.

Based on the diameter and the number of courses of the garment, it can be also suitable for being associated with an elbow, a wrist, and the like.

The knit fabric 1 and the garments 11, 12 and 13 are preferably made by a circular machine for knitwear and hosiery having a continuous motion rotating cylinder 24 that can be selectively and rotationally activated in reciprocating motion, which carries a plurality of needles 25 that can be selectively activated between an active position, wherein they intercept at least one yarn to be knitted, and an inactive position, wherein they do not intercept said yarn. The machine is furthermore provided with feeding means usually named as yarn fingers 26, for feeding the needles with at least one ground yarn, at least one main yarn, at least one elastic yarn and at least one restraining yarn.

The method provides for making a plurality of stitch courses by knitting at least the ground yarn, and the elastic yarn by uniform and/or reciprocating circular motion in order to make a knit fabric, comprising at least one stretch portion 4 and, next to at least part of the courses of the knit fabric, also knitting the main yarn and the restraining yarn, alternatively with the main yarn in order to obtain a fabric portion defined as restraining portion 8, in which the stitches obtained by knitting the main yarn and not knitting the first restraining yarn, alternate with stitches obtained by knitting the restraining yarn and not knitting the main yarn. Thereby lengths of floating restraining yarn 10' at the stitches comprising the main yarn and lengths of main floating yarn 10 at the stitches comprising the restraining yarn, are formed.

In detail the method provides the following steps:

a) at each fabric course, knitting at least one ground yarn 2 with the needles of the rotating cylinder and knitting one elastic yarn 5 such that groups of at least one needle knit said elastic yarn, which alternate with groups of at least one needle not knitting said elastic yarn in order to form a plurality of courses R1, R2, . . . , Rn of the fabric;

b) at least at one of said courses R1, R2, . . . , Rn, knitting the main yarn 3 with first groups of needles 27 brought to the active position to intercept the main yarn, which alternate with second groups of needles 28 brought to the inactive position to not intercept the main yarn; and knitting the restraining yarn 9 with the second groups of needles 28 brought to the active position as alternate with the first groups of needles 27 brought to the inactive position;

c) reiterating point b at subsequent courses, in order to make the restraining portion.

This way the first groups of needles intercepting the main yarn do not intercept the restraining yarn and vice versa the second groups of needles do not intercept the main yarn, but intercept the restraining one.

Figure 1A:
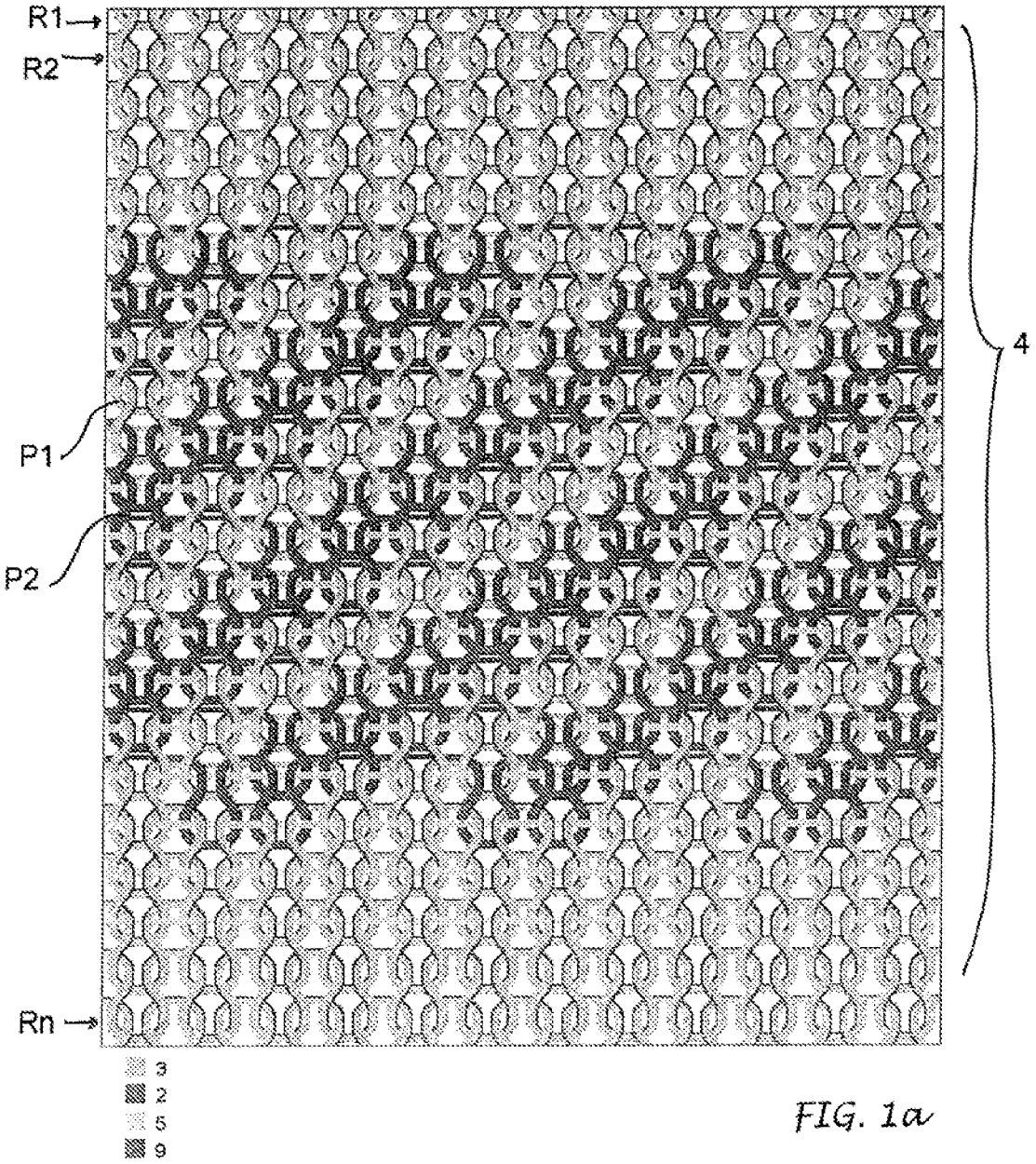
FIGS. 1*a* and 2*a* each show a layout of the stitches of the portions of the knit fabric encircled in FIGS. 1 and 2, respectively.
Figure 2A:
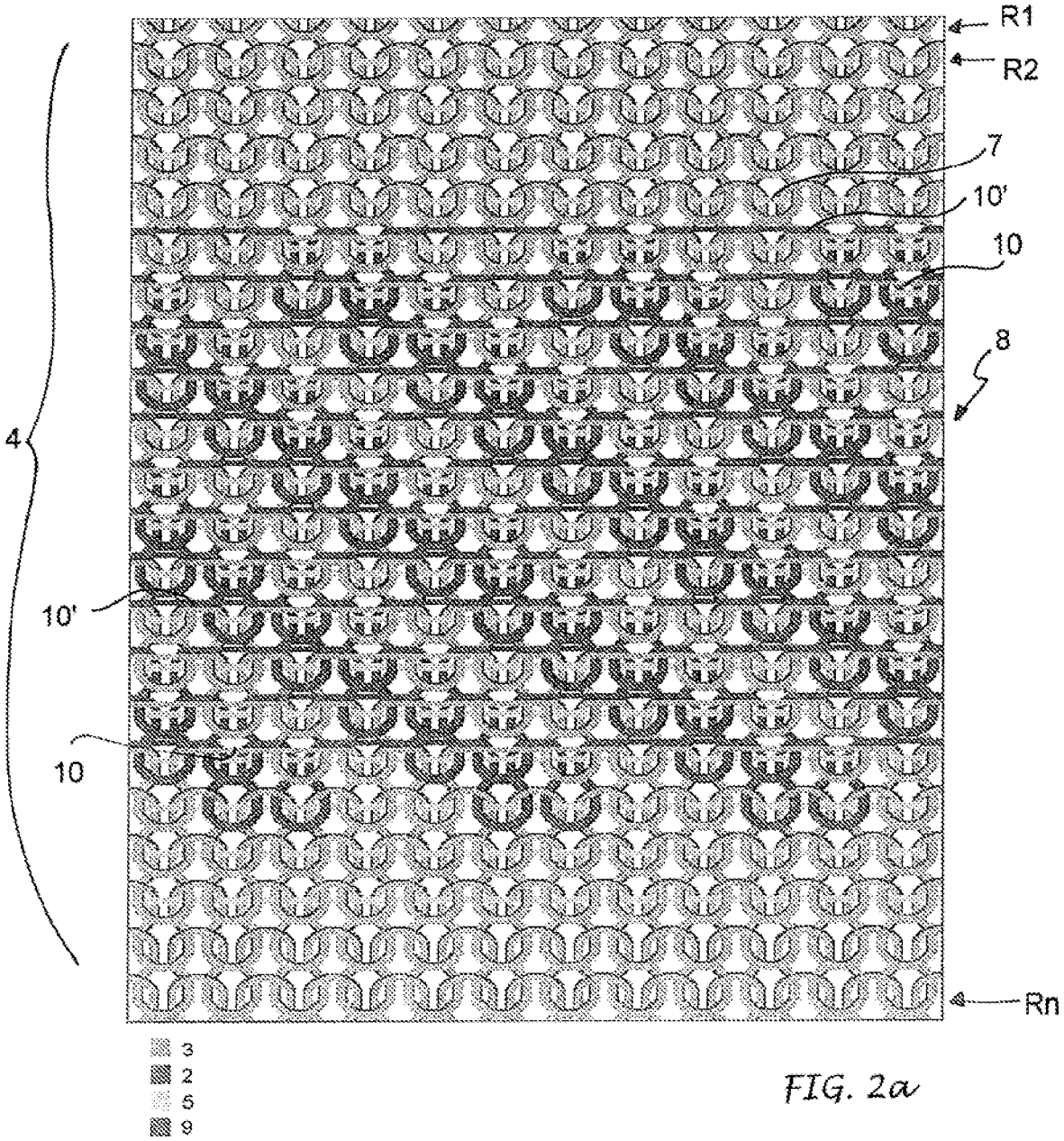
Figure 3A:
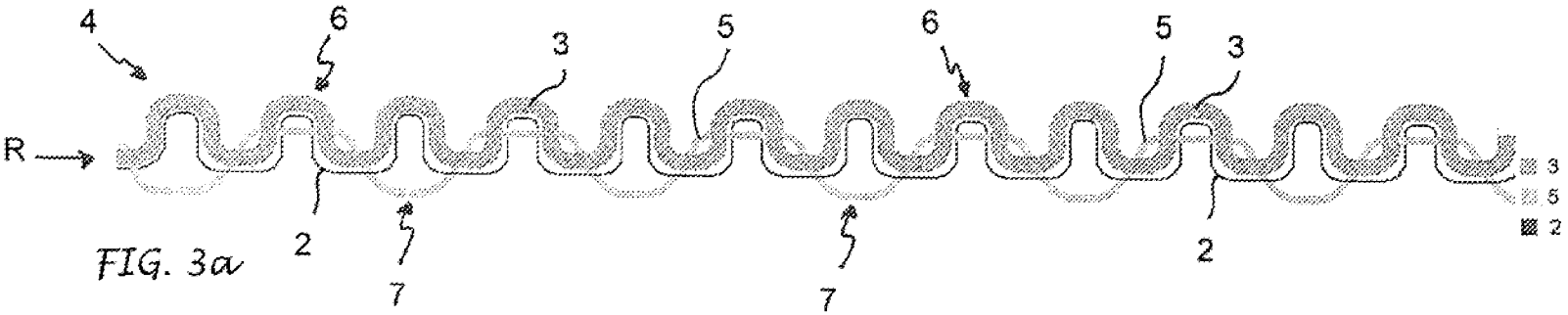
FIGS. 3*a* and 3*b* each show a portion of a course in two different parts of the knit fabric of FIG. 1.
Figure 3B:
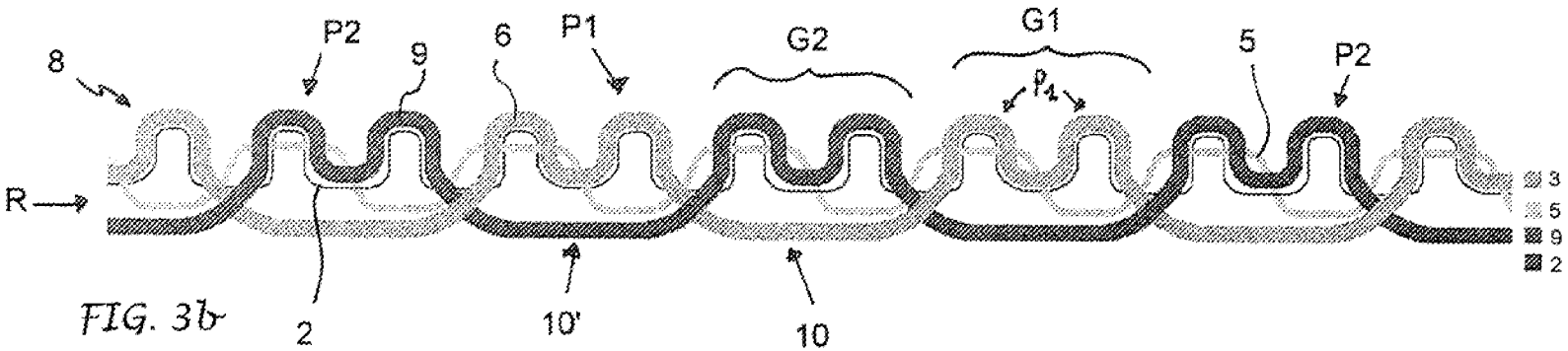

This allows a stretched knit fabric to be formed which, at least on one part thereof, also comprises a restraining portion defined by a sequence of stitches of two different yarns, as shown in FIGS. 1 and 1*a*, in which the stitches P1 of the main yarn are shown, which alternate with the stitches P2 of the restraining yarn, seen from a so-called front side of the fabric. FIGS. 2 and 2*a* show the aforesaid stitches seen from the other side of the fabric, named reverse; in such figures the floating lengths 10, 10' of the main yarn and of the restraining yarn are visible.

Both the first groups of needles 27 and the second groups of needles 28 should each comprise at least one needle. In case the first and second groups of needles comprise two needles, there are two needles knitting the main yarn by swerving the restraining one, which are followed by two needles knitting the restraining needle by swerving the main yarn, in their turn followed by two needles knitting the main yarn by swerving the restraining one and so on according to a selection 2:2.

However said first and second groups may comprise a larger number of needles and can have different numbers of needles both among them and the different first and second groups of a same course or different courses; thus, the first groups of needles could all be equal and each one comprise the same number of needles and the second groups could all be equal and each one comprise the same number of needles equal or different from that of the first groups, or else be in a different number within the same course, in order to form restraining portions with a shape fitting to the limb shape and having a restraining effect suitable to the body portion on which it is worn.

Preferably, in adjoining courses, the first groups of needles intercepting the main yarn but not intercepting the restraining yarn, and the second groups of needles not intercepting the main yarn but intercepting the restraining yarn in a course, in the subsequent one can be at least partially offset with respect to the previous one, such that at least some needles of the first groups of needles of the previous course belong to the second groups of needles of the subsequent course and do not intercept the main yarn, but intercept the restraining yarn and at least some needles of the second groups of needles intercept the main yarn, but do not intercept the restraining yarn, and so on to make a restraining portion of the type shown in the figures.

The afore described fabric can be part of a restraining garment, to be worn on a user's body joint.

In such a case the method for implementing such a garment also provides the step of:

at an intermediate plurality of said courses R1, R2, . . . , Rn, knitting at least the ground and the main yarns with part of the needles of the rotating cylinder activated in a reciprocating motion, in order to make a second intermediate semi-portion 17 having the shape of a bag.

Preferably, by suitably selecting the cylinder needles, the steps required for forming the restraining portion provide for forming a restraining portion comprising an upper strip 18 and a lower strip 19 both sloped with respect to the direction of the courses, respectively starting from the upper portion and the lower portion towards the first central semi-portion, such as to join at the latter.

Advantageously and in order to be fitted for the shape of the limb it has to be associated with, the starting and final parts of the restraining portion are made with a reduced number of first and second groups of needles.

Specifically, such steps are carried out as follows:

at the initial courses Ri of an initial part of the stretch portion, activating a limited number of said first groups of needles 27 and second groups of needles 28, such that said first and second groups of needles only comprise a small part of the needles of the rotating cylinder;

in the subsequent courses, increasing the number of said first and second groups of needles, until almost all or preferably all of the needles of the rotating cylinder belong to one of said first or second groups of needles;

decreasing the number of groups of the first and second groups of needles, such that at least part of the needles of the rotating cylinder constituting the second central semi-portion are not comprised;

in the subsequent courses, increasing the number of said first and second groups of needles, until almost all or preferably all of the needles of the rotating cylinder belong to one of said first or second groups of needles;

decreasing again the number of said first and second groups of needles; and at the final courses Rf of a final part of the stretch portion, activating a limited number of said first groups of needles 27 and second groups of needles 28, such that said first and second groups of needles only comprise a small part of the needles of the rotating cylinder.

By using different yarns and/or machines for hosiery or knitwear with different diameters or fineness, different types of restraining garments of different measures and sizes can be obtained, such as elastic ankle braces 11, socks with ankle braces 12, elastic knee braces 13 and the like. In fact, garments adapted to be worn on an elbow or wrist can also be obtained.

The garments obtained are substantially seamless, except for possible finish seams, such as the toe seams, in case the garment is a sock.

The method can provide the steps, known per se, also required for making one or two elastic finish edges 20 to be combined with the garment or at the ends thereof.

In case of a garment having the shape of a sock with ankle brace, the method also provides the steps required for forming the toe of the sock 23 and a possible step of sewing the toe itself, to be directly carried out on the circular machine, or with a subsequent operation. In such a garment the restraining portion can only extend at one part of the sock with ankle brace, while the stretch portion 4 can also extend in the remaining parts, such as the forefoot 22 and/or leg 21 portions, if present, and/or the toe portion 23.

What is claimed is:

1. A method for manufacturing a knit garment comprising at least one portion of a restraining fabric (1), comprising a sequence of courses (R1, R2, . . . Rn), obtained by making, next to at least part of said courses (R1, R2, . . . , Rn), at least one stretch portion (4) obtained by knitting at least one elastic yarn (5) and by making at least one restraining portion (8) next to at least part of said at least one stretch portion (4), wherein said at least one restraining portion (8) is obtained by alternatively knitting also a main yarn (3) with a restraining yarn (9) such that first groups (G1) of one or more first stitches (P1) are formed and comprise the main yarn (3), which alternate with second groups (G2) of one or more second stitches (P2) comprising the restraining yarn (9) and in that, at the first stitches (P1) containing the main yarn (3), floating lengths (10') of the restraining yarn (9), and, at the second stitches (P2) containing the restraining yarn (9), floating lengths (10) of the main yarn (3) extend, wherein the restraining fabric (1) is manufactured by a circular knitting machine having a continuous motion rotating cylinder (24) that is selectively and rotationally activated in reciprocating motion, which carries a plurality of needles (25) that are selectively activated between an active position, wherein they intercept at least one of the main yarn (3), the at least one elastic yarn (5), or the restraining yarn (9) to be knitted, and an inactive position, wherein they do not intercept said at least one of main yarn (3), the at least one elastic yarn (5), or the restraining yarn (9), the method comprising the steps of:

a) at each of the fabric courses (R1, R2, . . . , Rn), knitting with the needles (25) of the rotating cylinder (24) at least one ground yarn (2) and the at least one elastic yarn (5) to form the plurality of courses (R1, R2, . . . , Rn) of the fabric, in order to make at least one stretched portion (4);

b) at least at one of said courses (R1, R2, . . . , Rn), knitting at least one the main yarn (3) with first groups of needles (27) of the plurality of needles (25) brought to the active position to intercept the main yarn (3), which alternate with second groups of needles (28) of the plurality of needles (25) brought to the inactive position to not intercept the main yarn (3); and knitting the restraining yarn (9) with the second groups of needles (28) brought to the active position to intercept the restraining yarn (9), which alternate with the first groups of needles (27) brought to the inactive position, to not intercept the restraining yarn (9); and c) reiterating the step b) in order to make the at least one restraining portion (8) next to at least part of the at least one stretch portion (4);

wherein the step a) is actuated such that first groups of needles (27) comprising at least one needle knit said at least one elastic yarn (5), which alternate with second groups of needles (28) comprising at least one needle that do not knit said at least one elastic yarn (5), wherein the step a) is carried out such that, next to at least some courses (R1, R2, . . . , Rn) of the garment, an upper part (14), a first intermediate semi-portion (16) and a lower part (15) of the at least one stretch portion (4) are formed; and wherein a step b') is provided wherein, at an intermediate plurality of said courses (R1, R2, . . . , Rn) (R1, R2, . . . , Rn), the at least one ground yarn (2) is knitted with part of the plurality of needles (25) of the rotating cylinder (24) to make a second intermediate semi-portion (17) having the shape of a bag.

2. The method according to claim 1, wherein said garment is an elastic ankle brace (11), an elastic knee brace (13), or a sock with ankle brace (12), and wherein the method further comprises making an elastic edge (20) at ends or an end of said garment.

3. The method according to claim 1, wherein said garment is a sock with ankle brace (12) and wherein the method further comprises making a forefoot portion (22) and a toe portion (23).

4. The method according to claim 3, further comprising making a leg portion (21).

5. The method according to claim 1, wherein, by suitably selecting the cylinder needles (25), the steps b) and c) provide for forming the at least one restraining portion (8) comprising an upper strip (18) and a lower strip (19) both sloped with respect to the direction along which the courses (R1, R2, Rn) extend, starting respectively from the upper part (14) and the lower part (15) towards the first intermediate semi-portion (16), such as to join at the latter and being shaped such as to surround the second intermediate semi-portion (17).

* * * * *